33-235 SR
6/24/80 OR 4,208,801

United States Patent [19]
Blair

[11] 4,208,801
[45] Jun. 24, 1980

[54] MORTAR SIGHTING DEVICE

[76] Inventor: Oather Blair, 8415 Lou Ct., Louisville, Ky. 40201

[21] Appl. No.: 932,645

[22] Filed: Aug. 10, 1978

[51] Int. Cl.[2] ..... F41G 3/02
[52] U.S. Cl. ..... 33/235; 33/174 TC; 33/281
[58] Field of Search ..... 33/235, 241, 247, 245, 33/252, 261, 282, 285, 174 TC, 174 TD; 42/15; 89/41 B, 37 C

[56] References Cited

U.S. PATENT DOCUMENTS

| | | | |
|---|---|---|---|
| 600,084 | 3/1898 | Lewis | 33/281 |
| 2,579,067 | 12/1951 | Cunningham | 33/281 |
| 2,656,606 | 10/1953 | Porter | 33/281 |

FOREIGN PATENT DOCUMENTS

| | | | |
|---|---|---|---|
| 120918 | 3/1959 | U.S.S.R. | 33/174 TC |

*Primary Examiner*—Willis Little
*Attorney, Agent, or Firm*—Edward M. Steutermann

[57] ABSTRACT

Method and apparatus for aiming a missile firing weapon, such as a mortar, including a sighting device including a transit type aiming device with a mount means adapted to carry a reference plate rotatable in a generally horizontal plane on the mount means where the reference plate includes pivot means, generally centrally located thereon, aiming plate means superposed on the reference plate for rotation in a horizontal plane about the pivot means, releasable lock means to secure the aiming plate for rotation with the reference plate, vernier plate means superposed on the aiming plate for rotation about the pivot means where sight mount means are carried by the vernier plate means, lock means to secure the vernier plate for rotation with the aiming plate means; adjusting means to selectively rotate the vernier plate about the pivot means relative to the aiming plate, tubular sight means carried by the vernier plate to determine an aiming line of sight and missile firing weapon means having weapon sight means to be aligned with the aiming line of sight.

4 Claims, 4 Drawing Figures

MORTAR SIGHTING DEVICE

BACKGROUND OF THE INVENTION

Missile firing weapons for example mortars have been utilized in warfare for many years. Mortars are traditionally under the direct control of field commanders and provide support generally unavailable from artillery or air support.

In modern warfare, traditional mortar techniques are inappropriate because the procedures utilized for aiming mortars indicate the location of the mortar and make it vulnerable to enemy fire. Such present procedures provide for a forward observer who selects targets and communicates the location to a mortar team which includes personnel who go in front of the mortar to place aiming stakes, where in placing the aiming stakes the personnel are many times subject to enemy fire.

The aiming device of a mortar generally comprises a sighting apparatus fixed on a mount connected to the mortar barrel by releasing means, a reference or aiming mark disposed at a certain distance from the mortar and suitable control means for the mount whereby the mortar is aimed.

In general, the mortar is put in an initial direction termed an observation or datum direction determined, for example, by means of two suitably spaced aiming posts. In order to aim the mortar, the deflection drum of the sighting apparatus is turned so that the plane containing the axis of the aiming telescopic sight and the axis of rotation of the deflection drum is parallel with the axis of the mortar barrel, the horizontality control device of the mortar is actuated to bring the bubble of the transverse spirit level between reference marks and the biped mount is moved by pivoting the mortar barrel in the socket or seat of the base-plate on which the rear end of the barrel rests, until the center of the cross wires of the sight of the sighting apparatus is in alignment with the aiming-posts determining the observation direction.

If it is required to effect a fire switch through a given angle, that is, to change the direction of fire, for example through a certain angle toward the right, the known procedure is adopted in pivoting the deflection drum through the same angle toward the left and thereafter pivoting the mortar barrel toward the right until the center of the cross-wires of the sight is once more on the aiming-post.

But if this post is not at infinity, that is, if the new line of sight is not parallel with the previous line of sight, the angle through which the barrel turns is less than the desired angle. The difference is greater as the aiming-post is nearer the mortar, since it is only when this post is at infinity that the new line of sight is parallel with the previous line of sight and that the desired fire switch is obtained.

Now, in practice, it is sometimes necessary to fire from a defiladed position (cave, shell hole, etc.) which does not permit an aiming mark to be placed at a sufficient distance (about 50 meters) to suitably reduce the aiming error in azimuth because the aiming mark is not at infinity (parallax error).

If the aiming mark can only be positioned at a lesser distance from the mortar, for example, at 1.5 meters from the socket of the base plate, it is practically impossible to fire with sufficient accuracy in using a conventional aiming device notably in the case of firing in any direction in azimuth.

Moreover, present procedures require exercise time in setting up the mortar position and aiming so that mobility is sacrificed. These arrangements for aiming mortars have been developed as shown in U.S. Pat. No. 2,977,858 and my U.S. Pat. No. 4,062,190.

SUMMARY OF THE INVENTION

The present invention provides an aiming arrangement for a missile firing weapon, for example a mortar, where the weapon can be accurately aimed without use of stakes where the aiming device can be quietly set up and fired. The aiming device in accordance with the present invention is placed only a few meters from the mortars and therefore does not require exposure of the personnel to enemy fire. Moreover, the aiming device and method in accordance with the present invention permits the mortar to be fired accurately from a completely defiladed position or bunker concealed from all types of enemy fire.

Equally as important, devices and methods in accordance with the present invention provides good accuracy which can provide first round hits so that the device can be moved from position to position to provide effective surprise fire, in daylight or dark.

In difficult situations, one man can utilize devices and methods in accordance with the present invention to both aim and fire the mortar.

Moreover, devices and methods in accordance with the present invention are uncomplicated so that fewer training hours are required to prepare firing crews than required of previous procedures.

Briefly, the present invention provides a method and apparatus for aiming.

BRIEF DESCRIPTION OF THE DRAWINGS

One example of an arrangement and method within the scope of the present invention is shown in the accompanying drawings in which.

Figure 1:
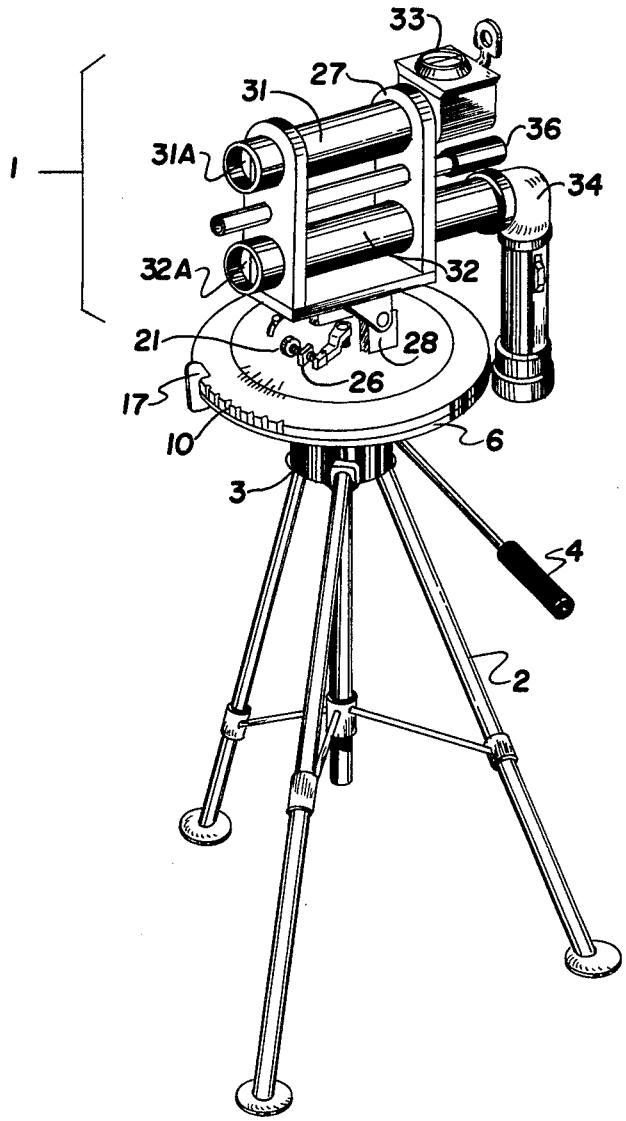
FIG. 1 is a perspective view of one example of a sighting arrangement within the scope of the present invention.

Referring first to FIG. 1, the sighting arrangement can be carried on appropriate mounting means, for example, a collapsible tripod 2. A pivot 3 can be provided having a release handle 4 to permit rotation of table 6 as further illustrated in FIG. 2, in a horizontal plane. Tripod 2 can include a spirit level (not shown) to provide guidance in adjusting the length of the legs of tripod 2 so that table 6 is level or, alternatively, a pivot 3 can be provided with appropriate knuckle joint to permit leveling of table 6.

Figure 2:
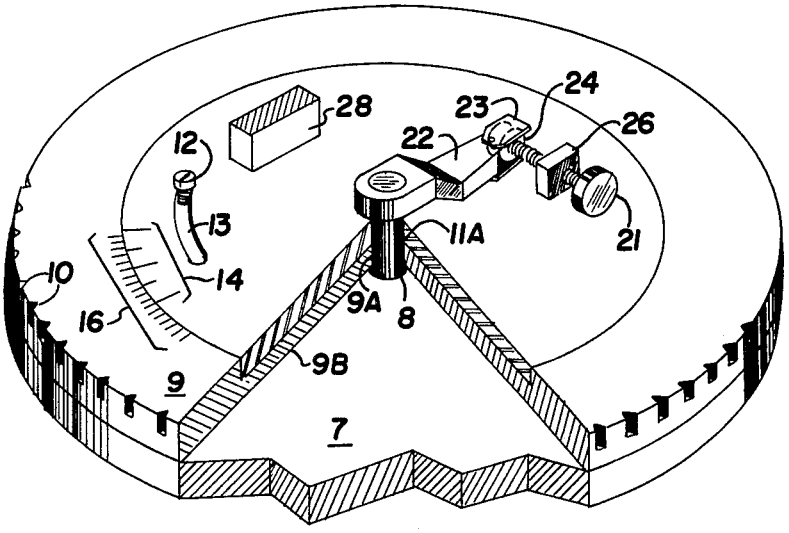
FIG. 2 is a view, partly in section, of a transit arrangement utilized in the sighting arrangement of FIG. 1.

Table 6, as shown in FIG. 2, includes a circular reference plate 7 carried for rotation on pivot 3 (by means not shown). A post 8 extends upwardly from the top of plate 7 and first receives a generally circular aiming plate 9 having generally the same diameter as reference plate 7 where an aperture 9A is provided in the middle of aiming plate 9 to receive post 8 for rotation thereabout. As shown, aiming plate 9 can be provided with a recessed center 9B of generally circular shape to receive an aiming plate as described hereafter.

Also, notches 10 can be provided around the circumference of plate 9 with the space between each notch the equivalent of a preselected number of azimuth degrees or mils (for example, 100).

A vernier plate 11 is superposed on aiming plate 9 and can have a diameter generally equal to the diameter of recess 9B to be received therein. Vernier plate 11 can be provided with a central aperture 11A to receive post 8 for rotation thereabout. A small upstanding post 12 can be provided on aiming plate 9 to be received in a semicircular slot 13 of vernier plat 11 to limit rotation of vernier plate 11 with respect to aiming plate 9. Also, a vernier scale 14 can be provided on the outer edge of plate 11 in cooperative relation with a reference mark 16 on the inner side of the upper surface of aiming plate 9 where the vernier scale 14 and the reference mark 16 cooperatively indicate the relative position of vernier plate 11 in unitary mils or degrees within the decade mils or degrees between notches 10 of plate 9.

In this regard, relative rotation is permitted between plate 7 and plate 9. However, it is necessary to lock plates 7 and 9 together when a selected direction of aiming has been determined as described hereinafter. For this purpose a spring biased lock or detent 17 (FIG. 1) is provided to releasably engage notches 10 of plate 9 to prevent unwanted further rotation of plate 9 on plate 7.

Once plate 9 is locked on plate 7, the direction of sight, as described hereinafter, can be further adjusted by means of adjusting screw 21 connected to an arm 22 fixed at one end to the top of post 8 and at the other end to a pivot 23 adapted to carry a nut 24 adapted to receive a threaded end of screw 21. Screw 21 is threadably journaled in an upstanding arm 26 fixed to vernier plate 11 so that rotation of screw 21 moves arm 26 along screw 21 to move plate 11 for fine adjustment of the position of plate 11 with the range of vernier scale 14.

As shown in the figure, a bracket 27 is carried by plate 11, and can be connected to the plate by a pivot arrangement 28 to allow bracket 27 to be pivoted up and down in a vertical plane, as described hereinafter.

Bracket 27 can be adapted to hold a tubular sight 31 which can have aligned vertical slit 31A in the front and rear aperatures to provide a vertical slit sight to define a line of sight as discussed hereinafter.

A lensamatic compass 33 is secured to the top of sight 31 with the hairline of the compass (not shown) in aligned relation with the slit in the front aperature of sight 31.

A second sighting arrangement, for example a tubular sight 32 having a front aperature with a slit 32A can be provided in bracket 27 and a light source, for example a flashlight 34, can be connected to the rear of tubular sight 32 so that, when light 34 is turned on, a slit of light is emitted through slit 32A to provide sighting means for night firing as described hereinafter.

Also, bracket 27 can be adapted to receive a telescope 36 where telescope 36 can include cross-hairs (not shown) to be used in positioning an associated missile firing device, for example a mortar as described hereinafter.

It will be understood that vertical slit 32A of tubular sight 32 and the vertical element of the cross-hair of telescope 36 are in aligned relation with the hairline of a compass 33.

Figure 4:
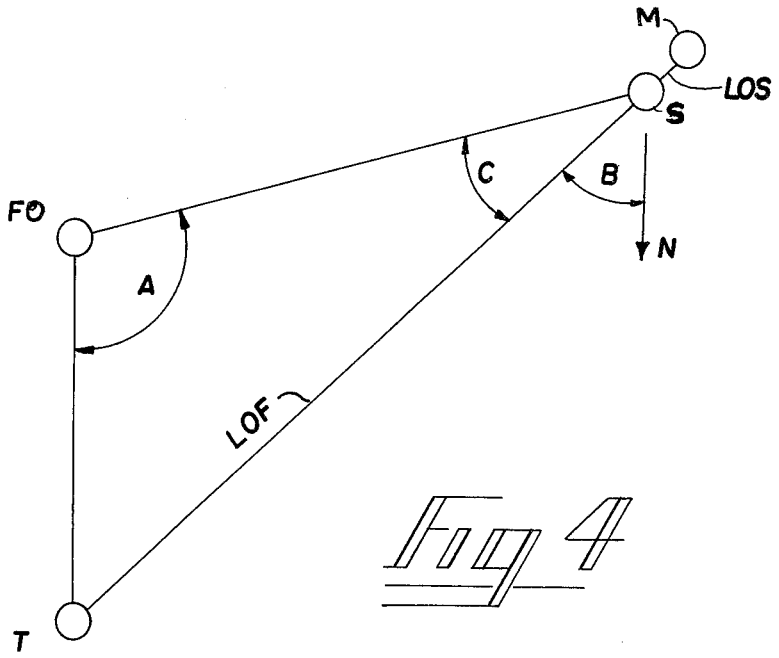

Referring now to FIG. 4, an arrangement is illustrated for sighting a mortar M to a target T by means of a sighting arrangement S in accordance with the present invention.

Figure 3:
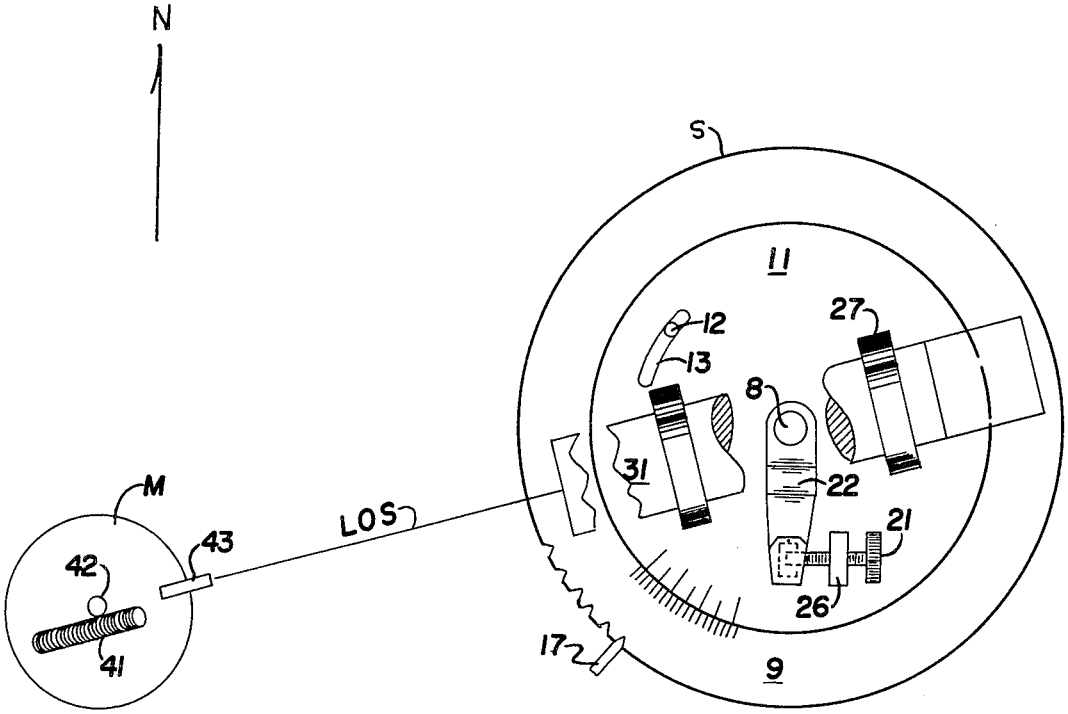
FIG. 3 is a schematic illustration of one example of the method in accordance with the present invention showing the relationship between a transit arrangement and a missile firing weapon; and, FIG. 4 is a diagramatic illustration of one method in accordance with the present invention.

For reference, magnetic North is indicated in FIGS. 3 and 4.

In FIG. 4, an illustration of an arrangement of the sighting device S and the mortar M is shown.

One mode of operation is as follows:

Upon location of the target, the sight S is placed at a convenient location and the base plate is leveled. Detent 17 is released from the reference plate and the reference plate rotated so detent 17 is located in the notch at 0 mils on the reference plate then the reference plate and aiming plate are rotated so sights 31, 32 and 36 are pointed due South. The base plate is then locked in position.

The forward observer then locates the target, determines the angles A and B, or C, and communicates the angle B or C to the squad at sight S. With base plate fixed, the aiming plate 9 and vernier plate 11 which carries sights 31, 32 and 36 is turned through the angle B which in the arrangement shown is the angle between due North and the line of fire LOF, where final azimuth adjustment is made by means of vernier screw 21 as previously described, so the sight is aimed rearwardly along line of sight LOS. A member of the squad then sights through sight 31 along line LOS which is the rearward extension LOF to guide emplacement of mortar 41 by sighting on mortar sight 43.

With the mortar, or other missile-filing apparatus so situated, only the inclination of the mortar 41 is left for adjustment.

Referring again to FIG. 1, a light 34 is provided to be used for night firing where the light source generates a light beam passed through slits 32A to define a line of sight LOS from sight S to the mortar sight 43 for alignment of the mortar as previously described.

Telescope 36 can be provided for aligning the mortar when the length of LOS is great.

The foregoing is but one example of apparatus within the scope of the present invention and it will be recognized that other arrangements, also within the scope of the present invention, will occur to those skilled in the art upon reading the foregoing.

The invention claimed is:

1. Apparatus for aiming a missile firing weapon including a mount means adapted to carry a reference plate rotatable on the mount means in a generally horizontal plane; pivot means carried by the reference plate; aiming plate means pivotably received on the reference plate means for rotation about the pivot means in a horizontal plane; releasable lock means to secure the aiming plate to the reference plate for rotation therewith and releasable to permit rotation of the aiming plate independent of the referenced plate; sight means carried by and for rotation with, said aiming plate to define a line of sight to align a missile firing weapon wherein said sight means includes elongate hollow tubular means having light source means to admit light to one end of said tubular means and vertically oriented aperature slit means at the opposite end of said tubular means where the end of said tubular means carrying said slit means is directed toward said missile firing weapon and where the light beam passing through said vertical slit defines a line of sight directed toward said missile firing weapon to aim same toward a selected target.

2. The invention of claim 1 wherein a vernier scale plate is superposed on said aiming plate and rotatable about said pivot means where said sight means is carried by said vernier scale plate; radially extending arm means are connected to said pivot means to extend radially outwardly from said pivot means in spaced relation above said vernier plate; connector means fixedly carried by said arm means; and vernier adjusting means received in said connector means; lug means to attach said adjusting means to said vernier scale plate so that measurement of said movement of said adjusting means moves said lug means and said vernier scale plate means relative to said reference plate means.

3. The invention of claim 1 wherein notches are regularly spaced around the periphery of said aiming plate and detent means are provided on said reference plate to releasably engage said notches whereby said reference plate and said aiming plate means are rotated together when said detent engages said notches and said aiming plate moves independently of said reference plate when said detent means is disengaged from said notches.

4. A method for sighting a missile firing weapon to a target utilizing an aiming device including mount means, adapted to carry a reference plate, said mount means having mount pivot means to permit rotation of said reference plate in a horizontal plane, pivot means carried by said reference plate, aiming plate means pivotably disposed on said reference plate for rotation about the pivot means in a horizontal plane, releasable lock means to secure the aiming plate to the reference plate for rotation therewith and releasable to permit rotation of the aiming plate independent of the reference plate; sight means carried by, and for rotation with, said aiming plate, including: setting the aiming plate and reference plate so said sight is pointed in a reference determining the included azimuth angle between the reference azimuth and the target azimuth, releasing the aiming plate for rotation on the reference plate and turning the aiming plate through the included azimuth angle so the sight means defines a line of sight along the target azimuth; settling the missile firing weapon to propel a missile along the line of sight and the target azimuth.

* * * * *